US010543392B2

(12) United States Patent
Lin et al.

(10) Patent No.: US 10,543,392 B2
(45) Date of Patent: Jan. 28, 2020

(54) PILLARED EXERCISER

(71) Applicant: Jui-Chun Lin, Taipei (TW)

(72) Inventors: Jui-Chun Lin, Taipei (TW); Chih Hsian Lee, Taipei (TW)

(73) Assignee: Jui-Chun Lin, Taipei (TW)

( * ) Notice: Subject to any disclaimer, the term of this patent is extended or adjusted under 35 U.S.C. 154(b) by 38 days.

(21) Appl. No.: 15/620,422

(22) Filed: Jun. 12, 2017

(65) Prior Publication Data

US 2018/0353797 A1 Dec. 13, 2018

(51) Int. Cl.

| | |
|---|---|
| ***A63B 21/00*** | (2006.01) |
| ***A63B 21/002*** | (2006.01) |
| ***A63B 71/06*** | (2006.01) |

(52) U.S. Cl.

CPC ..... *A63B 21/4033* (2015.10); *A63B 21/0023* (2013.01); *A63B 21/4035* (2015.10); *A63B 21/4037* (2015.10); *A63B 2071/0694* (2013.01)

(58) Field of Classification Search

CPC ..... A63B 21/0628; A63B 21/0004; A63B 21/00058; A63B 21/00069; A63B 21/00072; A63B 21/00076; A63B 21/00185; A63B 21/002; A63B 21/0023; A63B 21/012; A63B 21/0125; A63B 21/015; A63B 21/065; A63B 21/068; A63B 21/15; A63B 21/159; A63B 21/22; A63B 21/4023; A63B 21/4025; A63B 21/4027; A63B 21/4033; A63B 21/4035; A63B 21/4037; A63B 21/4041; A63B 21/4043; A63B 21/4049; A63B 22/0046; A63B 22/18; A63B 22/20; A63B 2022/0094; A63B 2022/0097; A63B 71/0036; A63B 71/06; A63B 71/0619; A63B 71/0622; A63B 2071/065; A63B 2071/0652; A63B 2071/0658; A63B 2071/0694; A63B 2209/00; A63B 2210/00; A63B 2210/50; A63B 2220/10; A63B 2220/16; A63B 2220/18; A63B 2225/09; A63B 2225/093

See application file for complete search history.

(56) References Cited

U.S. PATENT DOCUMENTS 1,385,916 A * 7/1921 Harris ..... A21C 3/021 492/14
2,208,729 A * 7/1940 Offutt ..... A21C 3/021 101/367

(Continued)

*Primary Examiner* — Gary D Urbiel Goldner
(74) *Attorney, Agent, or Firm* — Muncy, Geissler, Olds & Lowe, P.C.

(57) ABSTRACT

A pillared exerciser includes a pillar and an auxiliary bar stored in the pillar. A side surface of the pillar is provided with several auxiliary marks. The auxiliary marks include a pair of first auxiliary lines, a plurality of pairs of second auxiliary lines and a plurality of pairs of auxiliary signs. The first auxiliary lines are circumferentially extended on a central region of the side surface of the pillar. The second auxiliary lines and the auxiliary signs are circumferentially arranged at two ends of the side surface of the pillar. The auxiliary marks guide an exercising practicer to make motions of all parts of the body more exactly and effectively exercise the muscle that needs to exercise, thereby avoiding sport injuries. Besides, the auxiliary bar aids to satisfy the omni-directional requirement for exercising body and apparently improve the exercising effect.

11 Claims, 6 Drawing Sheets

(56) References Cited

U.S. PATENT DOCUMENTS

| | | | | |
|---|---|---|---|---|
| 6,398,694 | B1 * | 6/2002 | Bountourakis | A63B 21/015 482/109 |
| 9,415,258 | B1 * | 8/2016 | Higgins | A63B 21/068 |
| 9,693,929 | B2 * | 7/2017 | Faussett | A61H 15/0092 |
| 9,737,747 | B1 * | 8/2017 | Walsh | A01K 87/00 |
| 2005/0176565 | A1 * | 8/2005 | Dua | A21C 3/021 492/14 |
| 2007/0254791 | A1 * | 11/2007 | Lee | A21C 3/021 492/9 |
| 2007/0275834 | A1 * | 11/2007 | Reilly | A63B 15/00 482/91 |
| 2009/0176635 | A1 * | 7/2009 | Brinson | A61H 7/001 482/141 |
| 2009/0264267 | A1 * | 10/2009 | Ballif | A63B 21/0004 482/139 |

* cited by examiner

PILLARED EXERCISER

BACKGROUND OF THE INVENTION

Field of the Invention

The present invention relates to exercising auxiliary equipment, particularly to a pillared exerciser that improves the correctness and effectiveness of exercising motions.

Description of the Related Art

With the popularity of exercises, various exercisers appear in the market to assist in exercises. Nowadays, in addition to bodyweight training, various exercisers, such as yoga mats, foam rollers, fitness rings, stretch bands and swiss balls, are usually used to help practicers make better motions having more variety during exercise. Besides, there is a hollow exercise roller whose body is pressed down by external force, and the body has an inner space correspondingly deformed. However, when the hollow body is in use, it is easily and excessively deformed, so as not to effectively aid to make various motions.

Besides, a cylinder-shaped foam roller fully has elasticity and adaptability, eases muscle tension, and strengthens core muscle to achieve the balance for exercising a body. Thus, the foam roller is now an indispensable exerciser for yoga exercise. However, the foam roller generally has a single use status and a single use function, such that exercising practicers need to prepare various exercisers to exercise and consumers spend too much money on the exercisers. Furthermore, the exercisers are too bulky to be stored.

On the other side, the existing exercisers cannot determine whether the motion made by the exercising practicer is correct. The incorrect motions can greatly reduce the exercising effect and easily cause sport injuries.

To overcome the abovementioned problems, the inventor of the present invention invents a pillared exerciser, which assures the practicer of the correctness of motions and cooperates with an auxiliary bar to exercise other parts to improve the overall exercising effect.

SUMMARY OF THE INVENTION

To overcome the abovementioned problems, a primary objective of the present invention is to provide a pillared exerciser whose pillar has a side surface provided with several auxiliary marks, which guides all the parts of a body to make more correct motions, thereby exercising the muscles that needs to exercise and reducing the risks for sport injuries. In addition, the pillar cooperates with an auxiliary bar to achieve the omni-directional fitness effect.

To achieve the abovementioned objectives, the present invention provides a pillared exerciser, which comprises a pillar and an auxiliary bar. A side surface of the pillar is provided with a plurality of auxiliary marks. The auxiliary marks comprise a pair of first auxiliary lines, a plurality of pairs of second auxiliary lines and a plurality of pairs of auxiliary signs. Two first auxiliary lines of the pair of first auxiliary lines are spaced and circumferentially extended on a central region of the side surface of the pillar, and the plurality of pairs of second auxiliary lines and the plurality of pairs of auxiliary signs are circumferentially arranged at two ends of the side surface of the pillar, and two second auxiliary lines of each pair of second auxiliary lines respectively radiate from two ends of the side surface of the pillar to the central region, and two auxiliary signs of each pair of auxiliary signs are distributed at two ends of the side surface of the pillar in a staggered way. A center of an end surface of the pillar is provided with an accommodation recess. The auxiliary bar is separably inserted into the accommodation recess.

Using the pillared exerciser of the present invention, an exercising practicer makes a balance motion, such as tightening or holding a pair of hands or a pair of legs. According to the first auxiliary lines, the second auxiliary lines and the auxiliary signs, hands, legs or knees are placed on correct positions to exactly make various intended motions and effectively exercise muscles. Furthermore, the auxiliary bar helps hold down the chin and are squeezed by the thighs to greatly improve the exercising effect. The auxiliary bar is stored in the pillar. The auxiliary bar is easily stored and conveniently carried, so as to enhance the additional value and market competitive of products.

In the pillared exerciser of the present invention, the pillar is a solid pillar or a hollow pillar and has a shape of a cylinder. Alternatively, the pillar has two opposite arcuate side surfaces and two opposite planar side surfaces, and thus the pillar difficultly rolls. Besides, two ends of the side surface of the pillar respectively comprise two bezels and a sidewall of each bezel is attached to a side of a slip-proof mat, and the slip-proof mat is movably embedded in the bezel. The other side of the slip-proof mat is pulled from the bezel to the outside in use, so that the slip-proof mat is attached to the ground, thereby positioning and avoiding slipping the pillared exerciser. On top of that, the side surface of the pillar further has a plurality of slip-proof patterns, such as slip-proof particles, so as to achieve the slip-proof purpose. Additionally, an end surface of the pillar is further provided with a gradienter, which controls the verticality of the pillared exerciser upright placed.

Below, the embodiments are described in detail in cooperation with the drawings to make easily understood the technical contents, characteristics and accomplishments of the present invention.

DETAILED DESCRIPTION OF THE INVENTION

In order to clearly disclose the technical features of a pillared exerciser of the present invention, several embodiments are introduced as below in cooperation with figures, so as to obviously detail the technical features of the present invention.

Figure 1:
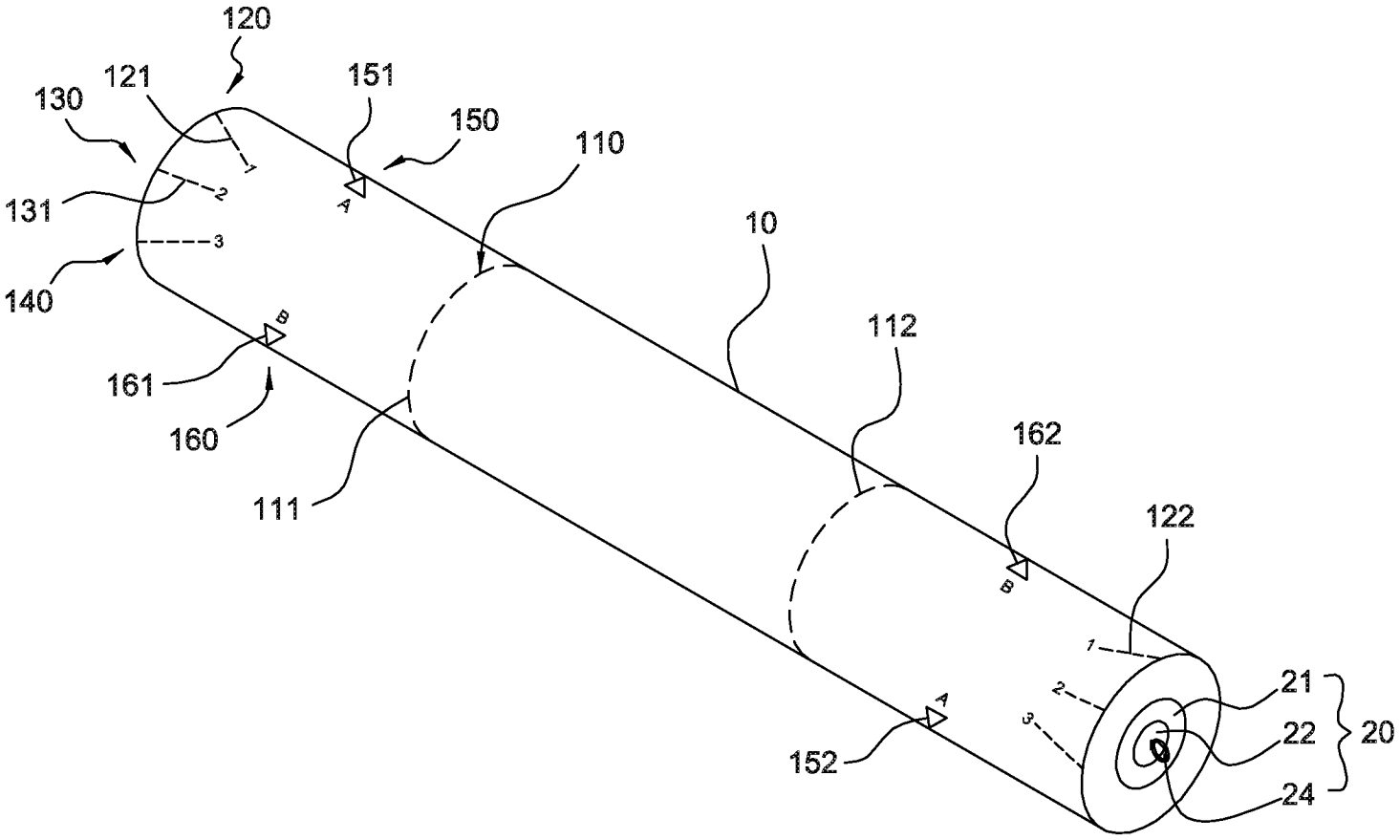
FIG. 1 is a perspective view of a pillared exerciser according to the first embodiment of the present invention.
Figure 2:
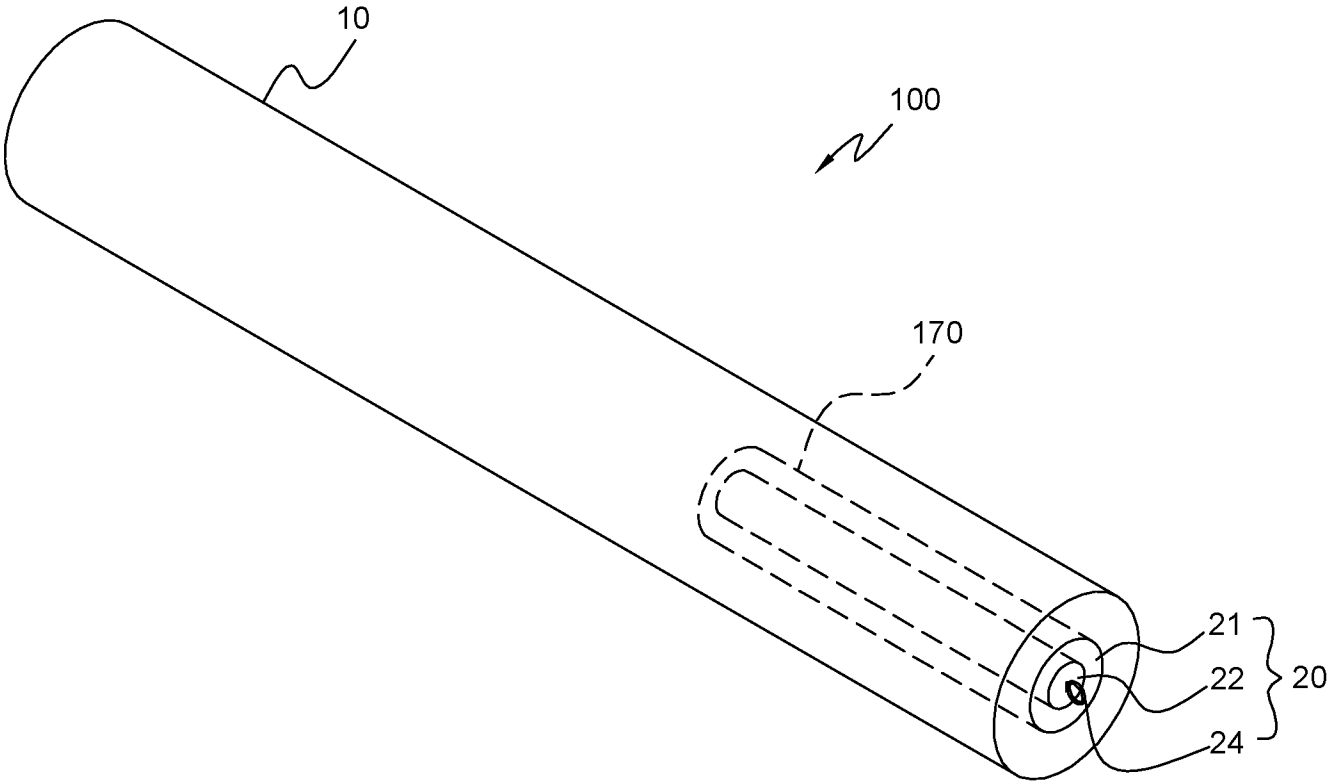
FIG. 2 is an exploded view of a pillared exerciser according to the first embodiment of the present invention.
Figure 3:
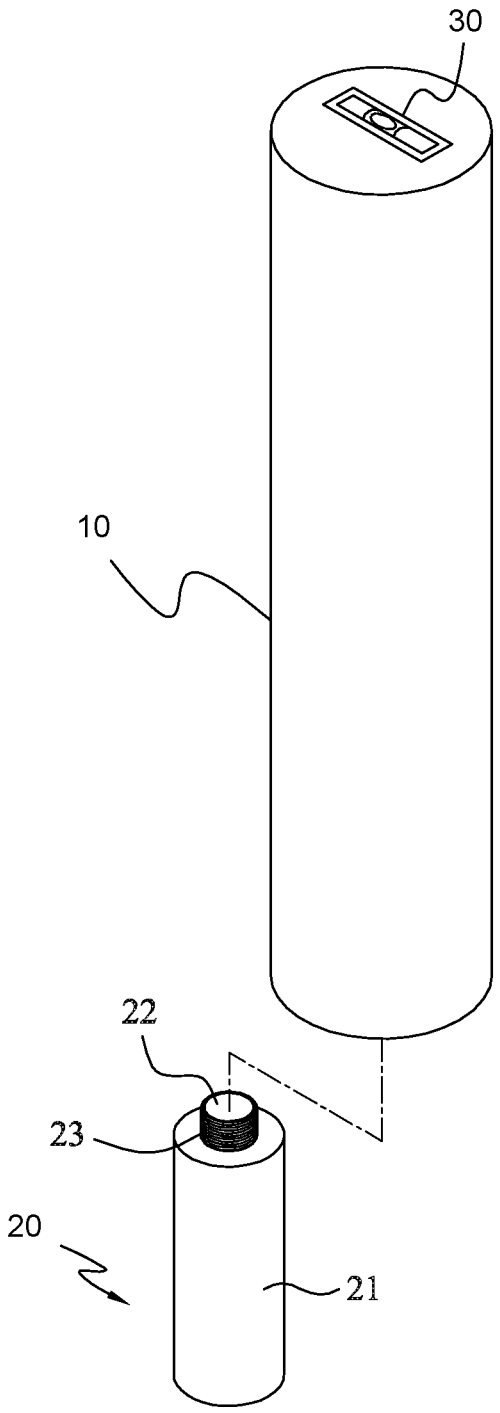
FIG. 3 is an assembly diagram schematically showing a pillared exerciser according to the first embodiment of the present invention.

Refer to FIG. 1. FIG. 1 is a perspective view of a pillared exerciser 100 according to the first embodiment of the present invention. Refer to FIG. 2 and FIG. 3. FIG. 2 is an exploded view of the pillared exerciser 100 according to the first embodiment of the present invention. FIG. 3 is an assembly diagram schematically showing the pillared exerciser 100 according to the first embodiment of the present invention.

As shown in FIG. 2, the pillared exerciser 100 of the embodiment comprises a pillar 10 and an auxiliary bar 20. The pillar 10 is a solid pillar or a hollow pillar. The solid pillar comprises vesicant plastic with buffer properties. The hollow pillar further comprises either of a hollow and thin iron tube or a hollow plastic tube, and a vesicant buffer layer covering the hollow and thin iron tube or the hollow plastic tube. In practice, its size, weight and density are adjusted to satisfy different requirements of users. For example, according to a size of an adult body, the pillar has a length of 60-70 cm and a diameter of 12-15 cm.

As shown in FIG. 1, a side surface of the pillar 10 is provided with a plurality of auxiliary marks, which comprises a pair of first auxiliary lines 110, three pairs of second auxiliary lines 120, 130 and 140 and two pairs of auxiliary signs 150 and 160. Two first auxiliary lines 111 and 112 of the pair of first auxiliary lines 110 are spaced and circumferentially extended on a central region of the side surface of the pillar 10. For example, the spaced distance is roughly equal to a width distance between midlines of left and right knees drawing close to each other. Thereby, an exercising practicer respectively aims his knees at the first auxiliary lines 111 and 112, and then makes various motions. The first auxiliary lines 111 can position the knees and hands of the exercising practice. The central region of the pillar 10 is usually held or pressed down by the hands to exercise.

In addition, the second auxiliary lines 120, 130 and 140 are circumferentially arranged at two ends of the side surface of the pillar 10. Take the pair of second auxiliary lines 120 for example. Two second auxiliary lines 121 and 122 of the pair of second auxiliary lines 120 respectively radiate from two ends of the side surface of the pillar 10 to the central region. Each pair of second auxiliary lines 120, 130 and 140 is circumferentially arranged and spaced on the pillar 10. For example, a distance between the second auxiliary line 121 of the first pair of second auxiliary line 120 and the second auxiliary line 131 of the second pair of second auxiliary line 130 is roughly equal to a width of a finger. Accordingly, when the exercising practicer uses hands to nip or press two ends of the pillar 10, fingers (such as thumbs) of two hands respectively aim at two second auxiliary lines of the chosen pair of second auxiliary lines 120, 130 or 140 to make various motions. As shown in the figure, the embodiment exemplifies three pairs of second auxiliary lines 120, 130 and 140, which are sequentially labeled Arab numbers 1, 2 and 3, but the present invention is not limited thereto. The amount and arrangement of the second auxiliary lines and patterns and words corresponded thereof can all be varied.

The auxiliary signs 150 and 160 are circumferentially arranged at two ends of the side surface of the pillar 10. Two auxiliary signs 151 and 152, 161 and 162 of each pair of auxiliary signs 150 and 160 are distributed at two ends of the side surface of the pillar 10 in a staggered way. In the embodiment, the auxiliary sign 151 of the first pair of auxiliary signs 150 is arranged at a front side of the left end of the pillar 10 in FIG. 3, and the auxiliary sign 152 is arranged at a rear side of the right end of the pillar 10 in FIG. 1. The auxiliary sign 161 of the second pair of auxiliary signs 160 is arranged at a rear side of the left end of the pillar 10 in FIG. 1, and the auxiliary sign 162 is arranged at a front side of the right end of the pillar 10 in FIG. 3. Accordingly, when the exercising practicer squeezes the pillar 10 between his legs, the left leg aims at the auxiliary sign 151 arranged at the front side of the left end of the pillar 10, and the right leg aims at the auxiliary sign 152 arranged at the rear side of the right end of the pillar 10. When the legs exchange their motions, the left leg aims at the auxiliary sign 161 arranged at the rear side of the left end of the pillar 10, and the right leg aims at the auxiliary sign 162 arranged at the front side of the right end of the pillar 10. Thus, the complete motion of holding the legs is finished once. Besides, the motion of crossing and holding the legs can also made. As shown in the figure, two pairs of auxiliary signs 150 and 160 respectively are labeled English letters A and B, but the present invention is not limited thereto. The amount and arrangement of the auxiliary signs and patterns and words corresponded thereof can all be varied.

The first auxiliary lines, the second auxiliary lines 123, 130 and 140, and the auxiliary signs 150 and 160 are printed, stamped or labeled on the pillar 10. In general, the first auxiliary lines, the second auxiliary lines 123, 130 and 140, and the auxiliary signs 150 and 160 do not overlap, but the present invention is not limited thereto. Their distribution can be varied.

On top of that, a center of an end surface of the pillar 10 is provided with an accommodation recess 170. The auxiliary bar 20 is separably inserted into the accommodation recess 170 (see FIG. 2). The auxiliary bar 20 further comprises a casing layer 21 and a fixed axle 22 penetrating through an axis of the casing layer 21. The casing layer 21 comprises vesicant material. The fixed axle 22 is an elastic steel bar or a plastic bar. A surface of an end of the fixed axle 22 has a thread 23 (see FIG. 3), which is screwed into the accommodation recess 170. Furthermore, the other end of the fixed axle 22 emerging from the casing layer 21 is provided with a foldable pull ring 24 (see FIG. 1), which is conveniently used to pull and store the auxiliary bar 20. Hence, when the exercising practicer holds down his chin, the auxiliary bar 20 is pulled from the accommodation recess 170 of the pillar 10 and squeezed between the chin and the neck. When the exercising practicer tightens the thighs, the auxiliary bar 20 is squeezed between the thighs.

Moreover, as shown in FIG. 3, the other end surface of the pillar 10 is further provided with a gradienter 30, which shows the horizontal state of the upright pillar 10. Accordingly, when the exercising practicer upright holds the pillared exerciser 100, the exercising practicer controls the end surface of the pillared exerciser 100 to be horizontal and maintain the verticality of the pillared exerciser 100 based on the measurement of the gradienter 30.

When the exercising practicer exercises, the pillared exerciser 100 guides correct positions of all parts of the body, such that the exercising practicer develops muscle strength, suppleness and balance stabilities of all the parts of the body. The pillared exerciser 100 is more particularly used for sports related to a pair of hands, a pair of legs, chin, thighs and knees. The pillared exerciser 100 is used doors and conveniently stored and carried.

In the abovementioned embodiment, the pillar 10 of the pillared exerciser 100 has a shape of cylinder with a flat top and a flat bottom. In practice, the pillared exerciser 100 has various shapes.

Figure 4:
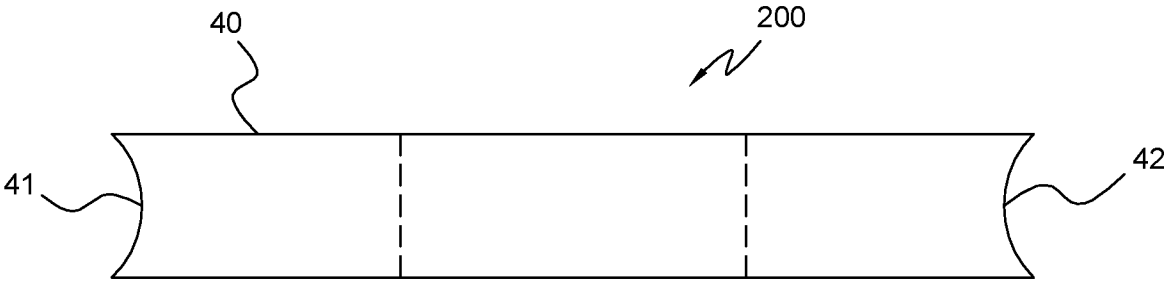
FIG. 4 is an axial cross-sectional view of a pillared exerciser according to the second embodiment of the present invention.

Refer to FIG. 4. FIG. 4 is an axial cross-section view of a pillared exerciser 200 according to the second embodiment of the present invention. Two end surfaces 41 and 42 of a pillar 40 are arcuate surfaces inwardly recessed. The inwardly-recessed degree roughly corresponds to the curve of the thigh, so as to help the exercising practicer squeeze the horizontal pillar 40 between the thighs.

Figure 5:
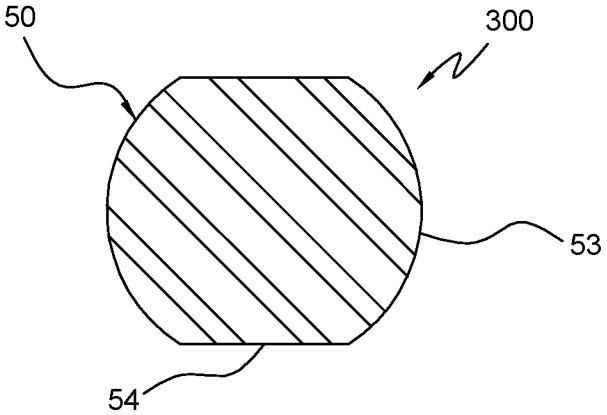
FIG. 5 is a circumferential cross-sectional view of a pillared exerciser according to the third embodiment of the present invention.

Refer to FIG. 5. FIG. 5 is a circumferential cross-sectional view of a pillared exerciser 300 according to the third embodiment of the present invention. A pillar 50 has two opposite arcuate side surfaces 53 and two opposite planar side surfaces 54. Due to the planar side surfaces 54, the pillared exerciser 300 difficultly rolls in use. In practice, the pillar 50 has at least one arcuate side surface 53 and at least one planar side surface 54 to achieve the similar effect.

Figure 6B:
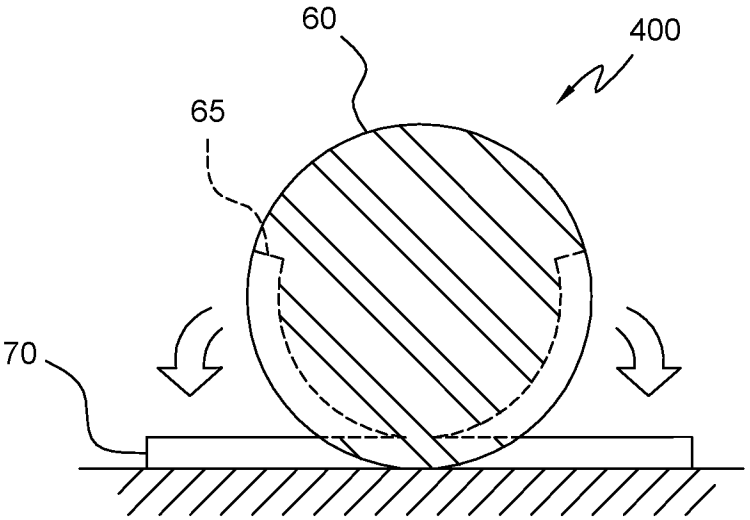
FIG. 6B is a usage diagram schematically showing a pillared exerciser according to the fourth embodiment of the present invention.
Figure 6A:
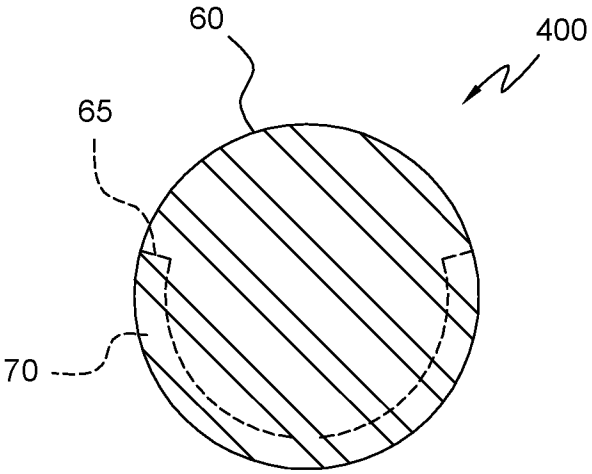
FIG. 6A is a circumferential cross-sectional view of a pillared exerciser according to the fourth embodiment of the present invention.

Refer to FIG. 6A and FIG. 6B. FIG. 6A is a circumferential cross-sectional view of a pillared exerciser 400 according to the fourth embodiment of the present invention. FIG. 6B is a usage diagram schematically showing the pillared exerciser 400 according to the fourth embodiment of the present invention. Two ends of a side surface of a pillar 60 are respectively provided with two slip-proof mats 70. An end of the slip-proof mat 70 is attached to a sidewall of a bezel 65, and the other end of the slip-proof mat 70 is movably embedded in the bezel 65. Accordingly, when the exercising practicer uses the pillared exerciser 400 on the ground, the slip-proof mat 70 in the bezel 65 at two ends of the side surface of the pillar 60 is pulled to the outside and spread on the ground, so as to position and stop slipping the pillared exerciser 400. As shown in the figure, the embodiment exemplifies two slip-proof mats 70, which are embedded in bezels 65 at two ends of the side surfaces of the pillar 60. According to the requirement of practical usage, the slip-proof mats 70 and the bezels 65 have different arrangement, amounts, sizes and shapes. Certainly, the arrangement can be horizontal, vertical or irregular. The figures described above are only to exemplify the present invention but not to limit the scope and application of the present invention.

Figure 7:
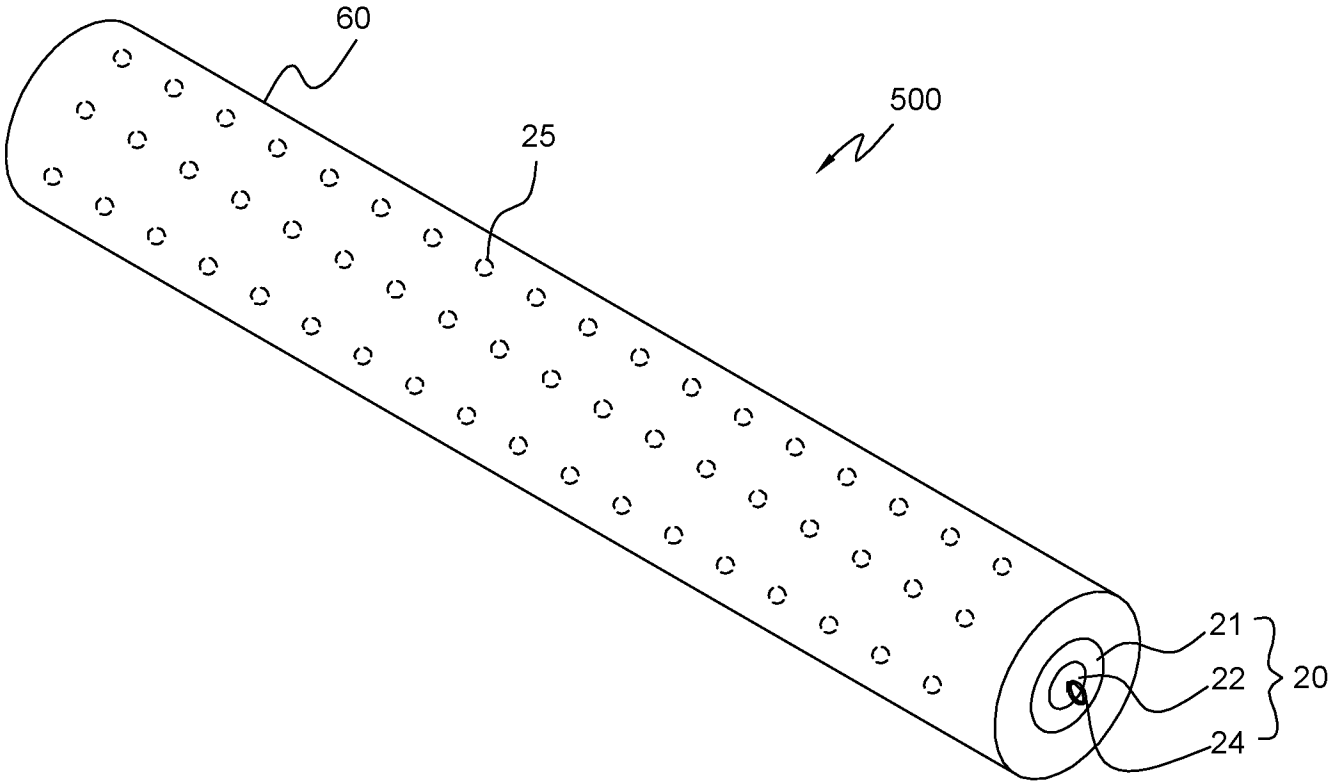
FIG. 7 is a perspective view of a pillared exerciser according to the fifth embodiment of the present invention.

Refer to FIG. 7. FIG. 7 is a perspective view of a pillared exerciser 500 according to the fifth embodiment of the present invention. A side surface of a pillar 80 has a plurality of slip-proof patterns, such as slip-proof particles 25, so as to enhance the surface friction of the pillar 80 and achieve the slip-proof effect. The amount, sizes and distribution of the slip-proof particles 25 can be varied according to requirements.

In conclusion, the pillared exerciser of the present invention includes the pillar and the auxiliary bar stored in the pillar, wherein the side surface of the pillar is provided with several auxiliary marks, which guide the exercising practicer to make motions of all the parts of the body more exactly. The auxiliary bar is used to exercise the muscle that needs to exercise and achieve the omni-direction fitness effect. The present invention can reduce the probability of sport injuries and widely suit people of all ages.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. An exercise roller adapted for exercising a body, comprising:

a pillar with a side surface thereof provided with a plurality of auxiliary marks to guide exercising motions, and a center of an end surface of said pillar is provided with an accommodation recess; and an auxiliary bar separably inserted into said accommodation recess;

wherein said auxiliary bar further comprises a casing layer and a fixed axle penetrating through an axis of said casing layer;

wherein an end of said fixed axle emerging from said casing layer is provided with a foldable pull ring.

2. The exercise roller according to claim 1, wherein said plurality of auxiliary marks comprises a pair of first auxiliary lines and a plurality of pairs of second auxiliary lines, said pair of first auxiliary lines, and two first auxiliary lines of said pair of first auxiliary lines are spaced and circumferentially extended on a central region of said side surface of said pillar, and said plurality of pairs of second auxiliary lines is respectively and circumferentially arranged at two ends of said side surface of said pillar, and each said pair of second auxiliary lines respectively radiate from said two ends of said side surface of said pillar toward said central region.

3. The exercise roller according to claim 2, wherein said plurality of auxiliary marks further comprises a plurality of pairs of auxiliary signs respectively and circumferentially arranged at two ends of said side surface of said pillar, and each said pair of auxiliary signs is respectively distributed at said two ends of said side surface of said pillar in a staggered way.

4. The exercise roller according to claim 1, wherein said pillar is a solid pillar or a hollow pillar.

5. The exercise roller according to claim 4, wherein when said pillar is the hollow pillar, said hollow pillar further comprises either of a hollow and thin iron tube or a hollow plastic tube, and a vesicant buffer layer covering said hollow and thin iron tube or said hollow plastic tube.

6. The exercise roller according to claim 4, wherein when said pillar is the solid pillar, said solid pillar comprises vesicant plastic.

7. The exercise roller according to claim 1, wherein said pillar is a cylinder.

8. The exercise roller according to claim 1, wherein said casing layer comprises vesicant material.

9. The exercise roller according to claim 1, wherein said fixed axle is an elastic steel bar or a plastic bar.

10. The exercise roller according to claim 1, wherein another end surface of said pillar is further provided with a gradienter.

11. The exercise roller according to claim 1, wherein said plurality of auxiliary marks comprises a plurality of pairs of auxiliary signs circumferentially arranged at two ends of said side surface of said pillar, and each said pair of auxiliary signs is respectively distributed at said two ends of said side surface of said pillar in a staggered way.

* * * * *